US007584734B1

(12) United States Patent
Fiorenza et al.

(10) Patent No.: US 7,584,734 B1
(45) Date of Patent: Sep. 8, 2009

(54) ENGINE STARTER ASSEMBLY

(75) Inventors: John Fiorenza, Slinger, WI (US); Steve Crouch, McFarland, WI (US); James A. Louden, Cambridge, WI (US)

(73) Assignee: Briggs and Stratton Corporation, Wauwatosa, WI (US)

( * ) Notice: Subject to any disclaimer, the term of this patent is extended or adjusted under 35 U.S.C. 154(b) by 0 days.

(21) Appl. No.: 12/418,937

(22) Filed: Apr. 6, 2009

Related U.S. Application Data

(63) Continuation of application No. 12/049,494, filed on Mar. 17, 2008.

(51) Int. Cl.
*F02N 7/00* (2006.01)
*F02N 1/00* (2006.01)

(52) U.S. Cl. ..... 123/179.31; 123/185.14

(58) Field of Classification Search ..... 123/179.1, 123/179.31, 185.1, 185.13, 185.14, 185.3, 123/185.5; 185/39, 41 A, 41 C, 41 R, 43; 60/625; 74/6, 7 R
See application file for complete search history.

(56) References Cited

U.S. PATENT DOCUMENTS

| | | | | | |
|---|---|---|---|---|---|
| 2,293,322 | A | | 8/1942 | Veach | |
| 2,636,478 | A | * | 4/1953 | Smyser | 418/153 |
| 3,116,595 | A | * | 1/1964 | Kent et al. | 60/418 |
| 3,169,841 | A | * | 2/1965 | Weis | 95/242 |
| 3,252,426 | A | * | 5/1966 | Parr | 417/222.1 |
| 3,824,978 | A | * | 7/1974 | Paquette | 123/185.14 |
| 3,853,109 | A | * | 12/1974 | Dooley | 123/185.14 |
| 4,463,555 | A | | 8/1984 | Wilcoxson | |
| 4,731,545 | A | | 3/1988 | Lerner et al. | |
| 4,981,120 | A | * | 1/1991 | Mangum, Jr. | 123/149 D |
| RE033,919 | E | | 5/1992 | Kristoff et al. | |
| RE33,919 | E | * | 5/1992 | Kristoff et al. | 123/179.31 |
| 5,140,254 | A | | 8/1992 | Katzman | |
| 5,287,832 | A | | 2/1994 | Uhl | |

(Continued)

FOREIGN PATENT DOCUMENTS

| | | |
|---|---|---|
| WO | 03/006823 | 1/2003 |

OTHER PUBLICATIONS

Devine Water Motor Company, "Red Devil" Water Powered Grinder. Retrieved from Rob's Pelton Place on the Net! Web site: http://www.oldpelton.net/devinepage.html. Published at least as early as Mar. 16, 2008. 3 pages.

(Continued)

*Primary Examiner*—Stephen K Cronin
*Assistant Examiner*—David Hamaoui
(74) *Attorney, Agent, or Firm*—Michael Best & Friedrich LLP

(57) ABSTRACT

A pressure washer, connected to a water source by a hose, includes a frame, an engine supported by the frame and having a crankshaft, a pump driven by the engine, a wheel supported for rotation relative to the frame, an input configured to receive water from the hose and discharge the water against the wheel to cause the wheel to rotate, and a spring having a first end that is coupled to the crankshaft and a second end that is rotatable about an axis relative to the first end in response to rotation of the wheel to wind the spring. The wound spring is released to rotate the crankshaft to start the engine.

20 Claims, 10 Drawing Sheets

U.S. PATENT DOCUMENTS

| | | | | |
|---|---|---|---|---|
| 5,456,585 | A * | 10/1995 | Stenild | 418/154 |
| 5,537,966 | A | 7/1996 | Ohnishi | |
| 5,718,255 | A * | 2/1998 | Gilpatrick et al. | 137/10 |
| 6,230,678 | B1 | 5/2001 | Gracyalny et al. | |
| 6,260,529 | B1 | 7/2001 | Gracyalny et al. | |
| 6,263,852 | B1 | 7/2001 | Gracyalny et al. | |
| 6,311,663 | B2 | 11/2001 | Gracyalny et al. | |
| 6,325,036 | B1 | 12/2001 | Gracyalny et al. | |
| 6,386,169 | B1 | 5/2002 | Gracyalny et al. | |
| 6,431,844 | B1 * | 8/2002 | Dexter et al. | 417/299 |
| 6,508,220 | B1 | 1/2003 | Akaike et al. | |
| 6,526,598 | B1 * | 3/2003 | Black | 4/214 |
| 6,588,390 | B2 | 7/2003 | Kawasaki et al. | |
| 6,595,176 | B2 | 7/2003 | Poehlman et al. | |
| 6,679,216 | B2 | 1/2004 | Nemoto et al. | |
| 6,679,217 | B2 | 1/2004 | Nieda et al. | |
| 6,694,941 | B2 | 2/2004 | Ueda et al. | |
| 6,718,931 | B2 | 4/2004 | Morishige et al. | |
| 6,739,303 | B2 | 5/2004 | Harada et al. | |
| 6,782,863 | B2 | 8/2004 | Leasure et al. | |
| 6,792,908 | B1 | 9/2004 | Shimizu | |
| 6,827,055 | B2 * | 12/2004 | Tsunoda et al. | 123/185.14 |
| 6,834,633 | B2 | 12/2004 | Sing et al. | |
| 6,901,899 | B2 | 6/2005 | Tsunoda et al. | |
| 6,959,680 | B2 | 11/2005 | Hashiba | |
| 6,981,482 | B2 | 1/2006 | Tsunoda et al. | |
| 7,004,139 | B2 | 2/2006 | Saito | |
| 7,069,896 | B2 | 7/2006 | Tsunoda et al. | |
| 7,093,577 | B2 | 8/2006 | Tohyama | |
| 7,114,479 | B1 | 10/2006 | Lee | |
| 7,128,041 | B2 | 10/2006 | Hashiba | |
| 7,140,341 | B2 | 11/2006 | Dahlberg | |
| 7,162,988 | B1 | 1/2007 | Liao | |
| 7,191,752 | B2 | 3/2007 | Schriever et al. | |
| 7,201,130 | B2 | 4/2007 | Hashiba | |
| 7,234,431 | B2 | 6/2007 | Adam et al. | |
| 7,252,065 | B1 | 8/2007 | Keeton | |
| 7,267,091 | B2 | 9/2007 | Arnold et al. | |
| 2007/0120368 | A1 * | 5/2007 | Baarman et al. | 290/43 |
| 2009/0120397 | A1 * | 5/2009 | Prior | 123/179.17 |

OTHER PUBLICATIONS

Pelton Wheel Water Turbine. Retrieved from http://people.rit.edu/rfaite/courses/tflab/Cussons/pelton/pelton.htm. Published at least as early as Mar. 16, 2008. 10 pages.

Water Motors. Retrieved from The Museum of Retro Technology Web site: http://www.dself.dsl.pipex.com/MUSEUM/POWER/watermotor/watermotor.htm. Published at least as early as Mar. 16, 2008; Updated May 30, 2008. 9 pages.

Various sections from Rob's Pelton Place on the Net! Website: http://www.oldpelton.net/. Published at least as early as Mar. 16, 200. 13 pages.

New, D. (2004). Intro to Hydropower. [Electronic version.] Homepower 103, Oct. & Nov. 2004, pp. 14-20.

* cited by examiner

ENGINE STARTER ASSEMBLY

RELATED APPLICATIONS

This application is a continuation of co-pending U.S. patent application Ser. No. 12/049,494 filed on Mar. 17, 2008, the entire content of which is incorporated herein by reference.

FIELD OF THE INVENTION

The present invention relates to internal combustion engines, and more particularly to starters for internal combustion engines.

BACKGROUND OF THE INVENTION

Internal combustion engines incorporated in outdoor power equipment (e.g., lawnmowers, etc.) typically include a manual pull-starter and/or an electric starter to initiate engine operation. Pull-starters rely upon the user of the outdoor power equipment to provide the energy to actuate the pull-starter, while electric starters rely upon electricity, either stored in a battery or supplied from a household power source (e.g., a wall outlet), to provide the energy to actuate the starter.

SUMMARY OF THE INVENTION

Engine-powered pressure washers, however, are not typically supplied with electric starters. As a result, operators of engine-powered pressure washers are typically required to manually pull-start the engines without mechanical assistance. Manually pull-starting the engine can be difficult or impossible for some individuals. Electric pressure washers, which use electrical power from a household source, are an alternative to engine-powered pressure washers. However, electric pressure washers often are not capable of the flow rates and discharge pressures generated by engine-powered pressure washers.

The present invention provides, in one aspect, a pressure washer connected to a water source by a hose. The pressure washer includes a frame, an engine supported by the frame and having a crankshaft, a pump driven by the engine, a wheel supported for rotation relative to the frame, an input configured to receive water from the hose and discharge the water against the wheel to cause the wheel to rotate, and a spring having a first end that is coupled to the crankshaft and a second end that is rotatable about an axis relative to the first end in response to rotation of the wheel to wind the spring. The wound spring is released to rotate the crankshaft to start the engine.

The present invention provides, in another aspect, a pressure washer connected to a water source by a hose. The pressure washer includes a frame, an engine supported by the frame and having a crankshaft, a pump driven by the engine, and an engine starter assembly. The engine starter assembly includes a housing supported by at least one of the frame and the engine, a wheel rotatably supported by the housing, an input configured to receive water from the hose and discharge the water against the wheel to cause the wheel to rotate, a spring having a first end and a second end that is rotatable about an axis relative to the first end in response to rotation of the wheel, a transmission positioned between the wheel and the spring configured to transfer rotation of the wheel to the second end of the spring to wind the spring, a clutch that connects the first end of the spring to the crankshaft to transfer movement between the spring and the crankshaft, and a lock configured to engage the crankshaft to prevent rotation of the crankshaft while the spring is being wound. The wound spring is released by disengaging the lock to rotate the crankshaft and start the engine.

The present invention provides, in yet another aspect, a pressurized fluid-delivery apparatus including a frame, an engine supported by the frame and having a rotatable member, a pump driven by the engine to discharge a pressurized fluid, and an engine starter assembly. The engine starter assembly includes an accumulator device coupled to the rotatable member and configured to store energy, an input device coupled to the accumulator device and configured to impart a force on the accumulator device to move at least a portion of the accumulator device, and a fluid input configured to receive the fluid stream and direct the fluid stream toward the input device to move the input device. Energy from the fluid stream is stored in the accumulator device due to the impingement of the fluid stream on the input device. The stored energy in the accumulator device is thereafter released to rotate the rotatable member to start the engine.

The engine starter assembly facilitates starting an internal combustion engine of a pressurized fluid delivery apparatus or a pressure washer without necessitating a large input force from an operator (e.g., a rope pull) to manually start the engine. As a result, the engine starter assembly enables operators, who would otherwise be incapable or have insufficient strength to manually start the engine by a rope pull, to use an engine-powered pressure washer, potentially expanding the number of people who can use engine-powered pressure washers. The engine starter assembly provides the added benefit that the working fluid (i.e., water) discharged by the pressure washer and the pressurized fluid used with the engine starter assembly share a common source (e.g., a household water spigot).

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
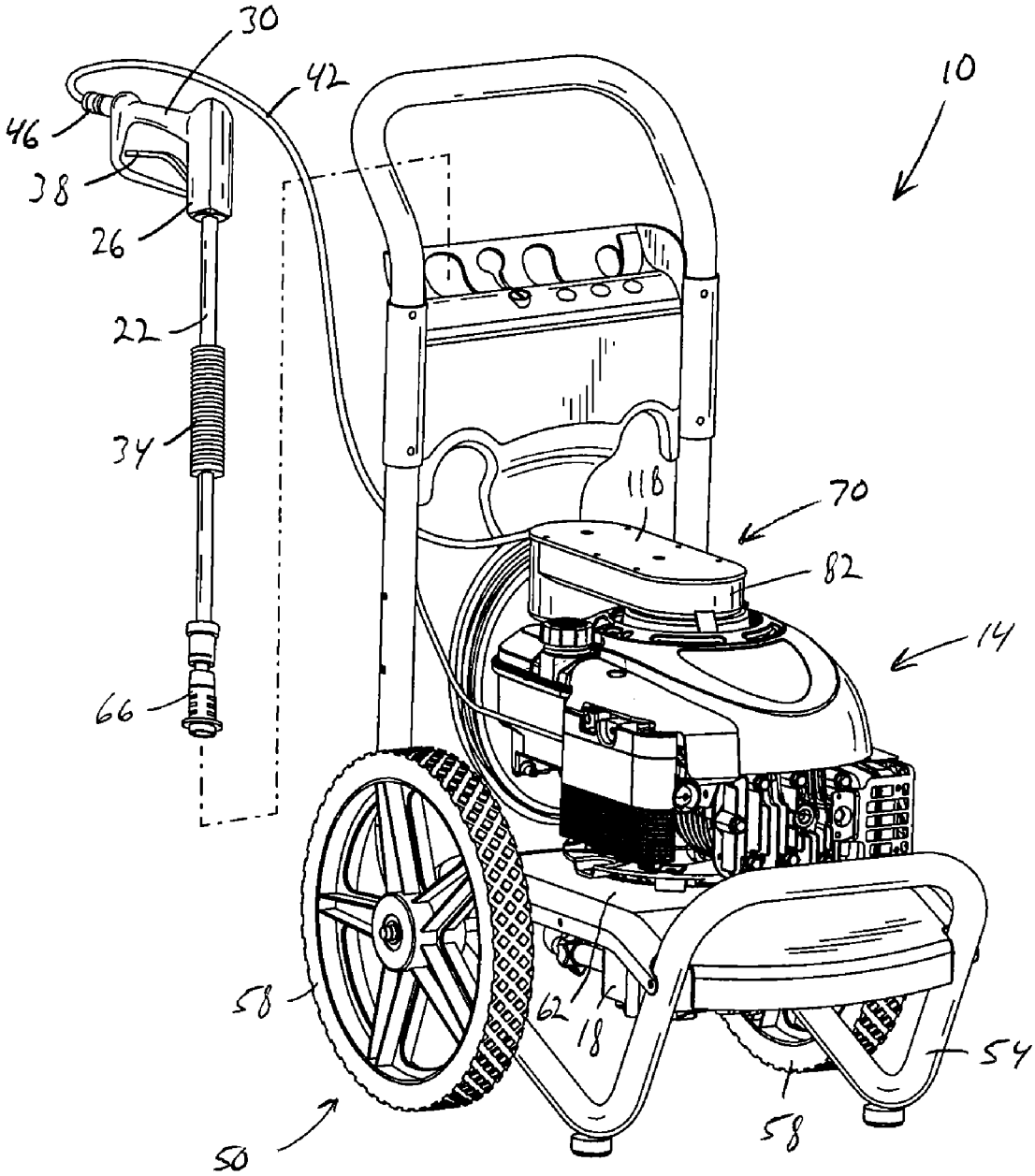
FIG. 1 is a front perspective view of a pressurized fluid delivery apparatus incorporating an engine starter assembly of the present invention.
Figure 2:
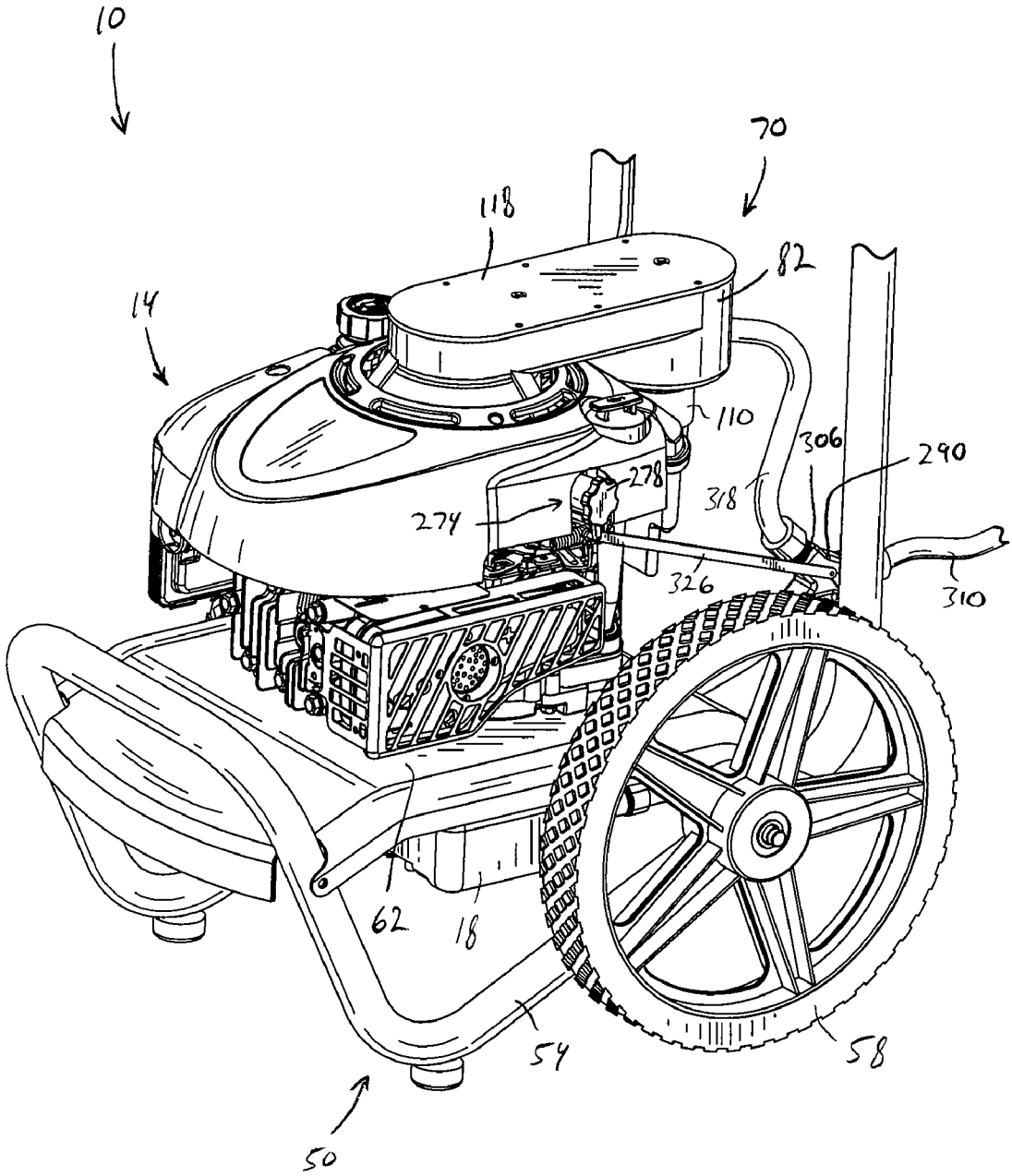
FIG. 2 is another front perspective view of the pressurized fluid delivery apparatus and engine starter assembly of FIG. 1.
Figure 3:
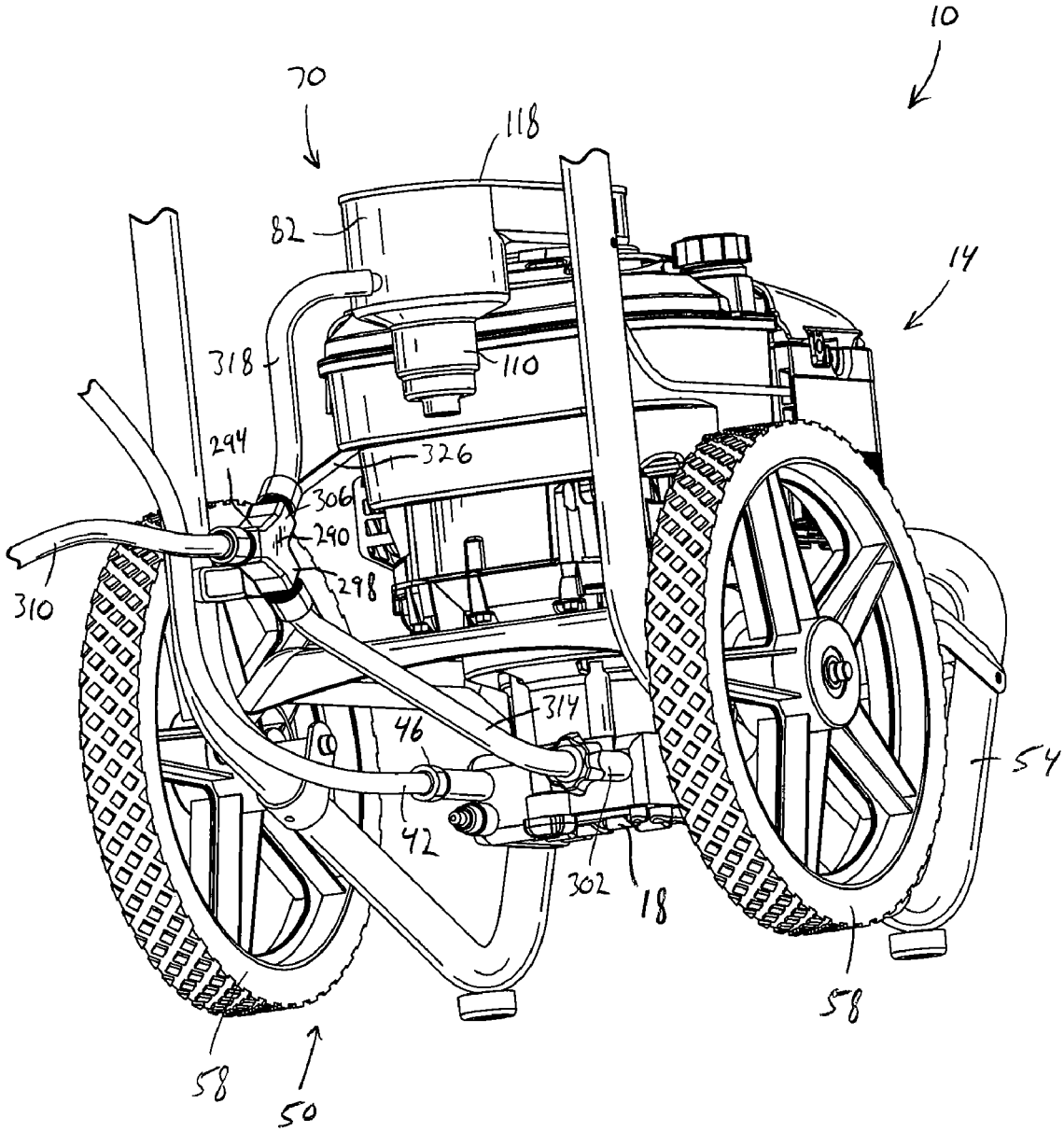
FIG. 3 is a rear perspective view of the pressurized fluid delivery apparatus and engine starter assembly of FIG. 1.

FIGS. 1-3 illustrate a pressurized fluid delivery apparatus, or a pressure washer assembly 10, including an engine 14 and a pump 18 operably coupled to the engine 14 to provide a pressurized fluid to a rigid conduit, or wand 22 (see FIG. 1). As understood in the art, the pump 18 may receive a supply of low-pressure fluid, pressurize the fluid, and discharge the pressurized fluid to the wand 22. The wand 22 is coupled to a gun assembly 26 and acts as an extension to the gun assembly 26. The gun assembly 26 includes a hand grip 30 for a user to grasp with one hand, and the wand 22 includes a handle 34 to grasp with the other hand. A trigger 38 is located near the hand grip 30 to allow the user to selectively operate the gun assembly 26. The gun assembly 26 is fluidly connected with the pump 18 by a flexible hose 42, which allows the engine 14 and pump 18 to remain in one place while the user moves around and operates the gun assembly 26. Any number of conventional fluid couplings 46 (e.g., quick-disconnect fluid couplings, etc.) may be used to fluidly connect and secure the hose 42 to the pump 18 and to the gun assembly 26, respectively. Further, the pressure washer assembly 10 includes a cart 50 having a frame 54, wheels 58 rotatably coupled to the frame 54, and a platform 62 coupled to the frame 54 to support the engine 14 and pump 18. Alternatively, the pressure washer assembly 10 may include a frame of a different configuration to support the engine 14 and pump 18.

FIG. 1 illustrates a fluid accessory 66 coupled to the wand 22. The pressurized fluid exits the wand 22 via the fluid accessory 66. The fluid accessory 66 is adjustable to shape the discharged pressurized fluid into a spray pattern desirable for performing specific high-pressure cleaning applications. For example, the fluid accessory 66 may be adjusted to provide a wide-angle spray pattern to clean a large surface. However, the fluid accessory 66 may also be adjusted to provide a narrow-angle spray pattern to clean a small surface. Also, the fluid accessory 66 may include an adjustable nozzle assembly to alter the pressure of the discharged fluid. Alternatively, the pressure washer assembly 10 may include a non-adjustable accessory coupled to the end of the wand 22 to shape the discharged pressurized fluid into a specific, non-adjustable spray pattern.

Figure 4:
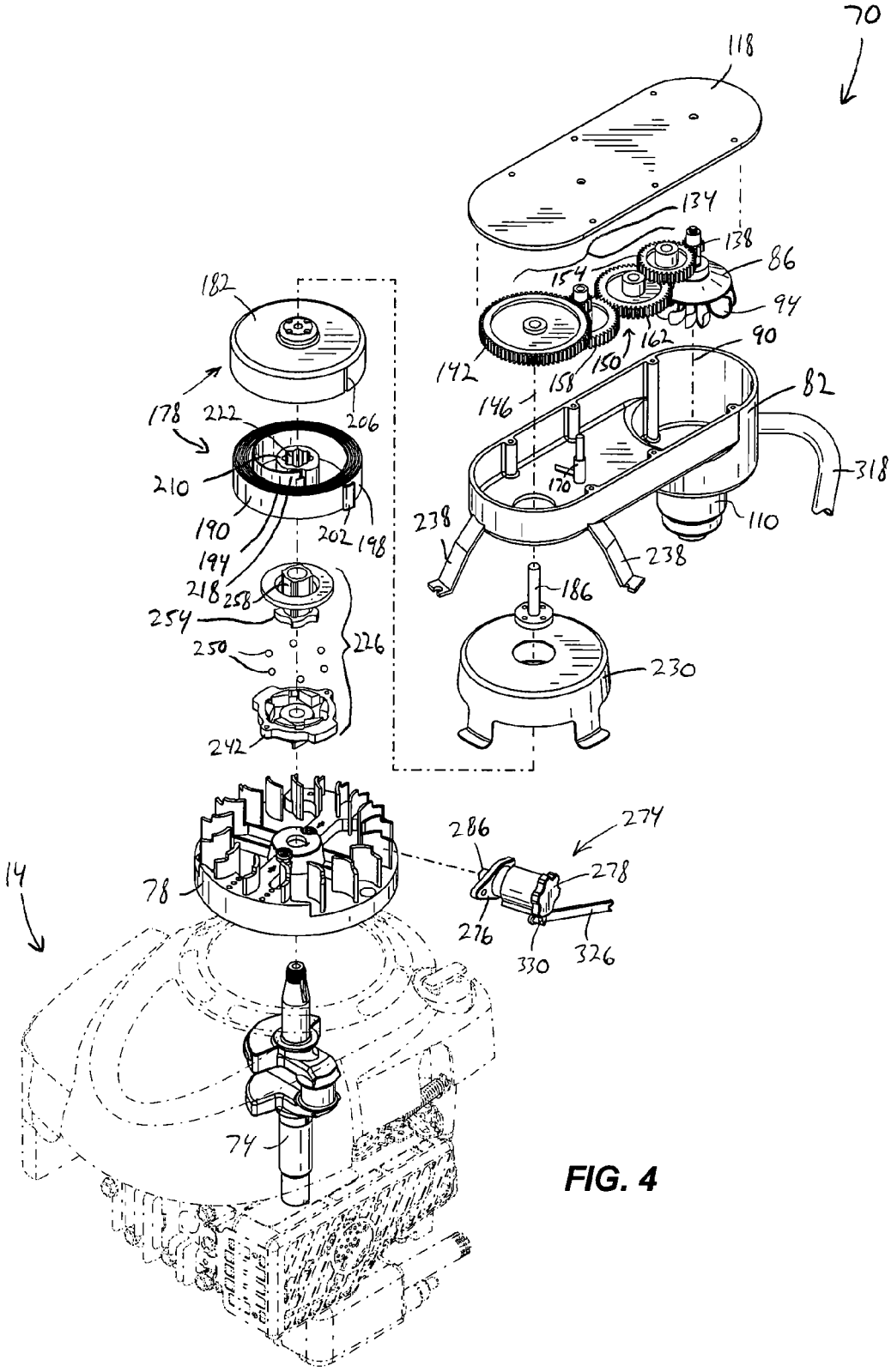
FIG. 4 is an exploded perspective view of the engine starter assembly of FIG. 1.

With reference to FIGS. 1-3, the pressure washer assembly 10 includes a starter assembly 70 coupled to a rotatable member of the engine 14 to start the engine 14. With reference to FIG. 4, the starter assembly 70 is coupled to an output shaft or a crankshaft 74 of the engine 14. Alternatively, the starter assembly 70 may be coupled to another rotatable member of the engine 14 (e.g., a fan, a flywheel, a fan/flywheel assembly 78, a gear, a belt-drive pulley rotatable with the crankshaft 74, etc.). The starter assembly 70 includes a housing 82 and an input device 86 rotatably supported in the housing 82 about an axis 90. The input device 86 includes a plurality of input members 94 arranged about the axis 90. Each of the input members 94 is preferably substantially cup-shaped, including opposed arcuate surfaces 96 (see FIG. 7). Alternatively, the input device 86 may be configured as a Pelton wheel, having dual cup-shaped input members arranged about the axis 90.

Figure 6:
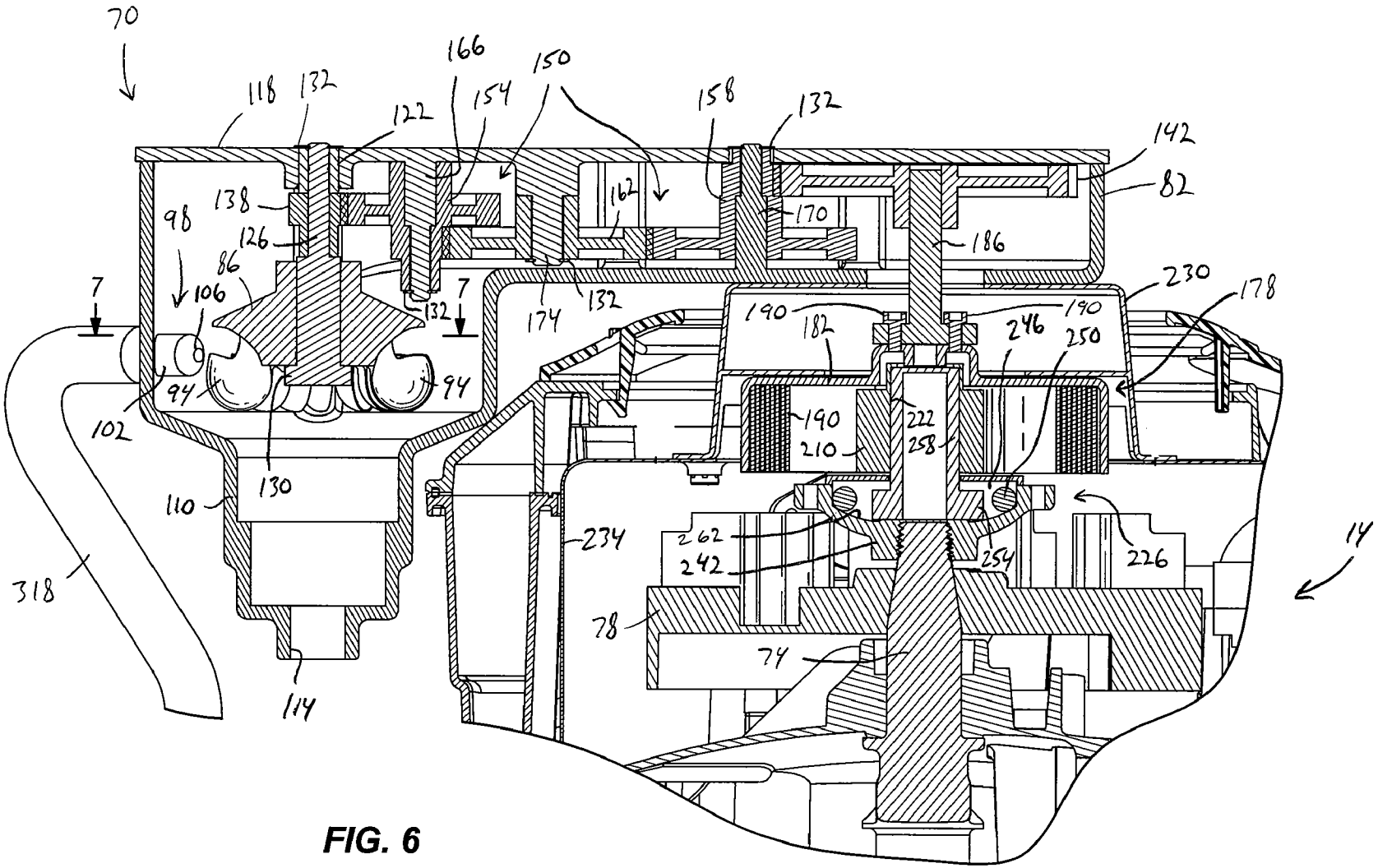
FIG. 6 is a side cutaway view of the engine starter assembly of FIG. 1, illustrating the components of the engine starter assembly.

With reference to FIG. 6, a fluid input 98 is coupled to the housing 82 and is in fluid communication with a source of pressurized fluid (see additional discussion below). In the illustrated construction, the fluid input 98 is in the form of a nozzle 102 integrally formed with the housing 82. Alternatively, the nozzle 102 may be a separate component of the housing 82, and may be coupled to the housing 82 in any of a number of different ways. In one construction of the starter assembly 70, the nozzle 102 includes an orifice 106 having a diameter of about one-tenth of an inch, sized for operation with a source of pressurized fluid (e.g., a typical residential outdoor faucet or other water utility connection) having an operating pressure between about 40 psi and about 80 psi. Alternatively, the orifice 106 may have a different diameter depending upon the operating pressure of the source of pressurized fluid. With reference to FIG. 6, the housing 82 also includes a tapered portion 110 having an outlet 114 disposed toward the bottom of the tapered portion 110.

Figure 7:
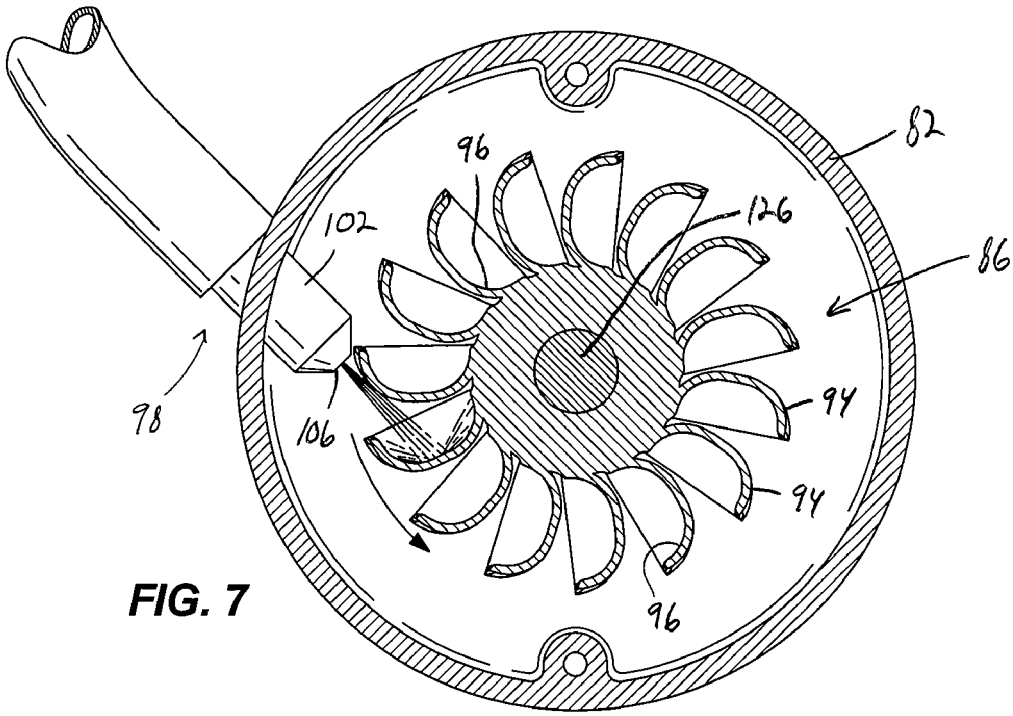
FIG. 7 is a top cutaway view of the engine starter assembly of FIG. 1, illustrating fluid impinging upon an input device of the starter assembly.

With reference to FIG. 7, the nozzle 102 is oriented relative to the housing 82 and the input device 86 to discharge a pressurized fluid against the individual input members 94 of the input device 86 as the input device 86 rotates about the axis 90. Specifically, in operation of the starter assembly 70, the pressurized fluid impinges upon a middle portion of each of the input members 94 and splits into multiple fluid streams. At least some of the fluid is redirected away from the middle portion and toward the respective arcuate surfaces 96. The arcuate surfaces 96 subsequently redirect the fluid in a direction substantially opposite that of the pressurized fluid impinging upon the input members 94. In operation of the starter assembly 70, fluid discharged from the nozzle 102, after impinging upon the input members 94 of the input device 86, flows down the tapered portion 110 and exits the housing 82 through the outlet 114.

With reference to FIG. 4, the starter assembly 70 further includes a cover 118 coupled to an upper portion of the housing 82 to substantially enclose the input device 86 within the housing 82. As shown in FIG. 6, a bushing 122 is coupled (e.g., a press-fit) to an interior surface of the cover 118, and a shaft 126 supporting the input device 86 for rotation about the axis 90 is supported for rotation in the bushing 122. In the illustrated construction of the starter assembly 70, the shaft 126 includes a flange 130 at one end upon which the input device 86 is supported, and a groove at an opposite end through which a C-clip 132 is received to suspend the shaft 126 and input device 86 from the cover 118. Alternatively, the input device 86 may be supported within the housing 82 in any of a number of different ways.

With reference to FIG. 4, the starter assembly 70 also includes a transmission 134, responsive to rotation of the input device 86, positioned in the housing 82. Specifically, the transmission 134 includes a drive gear 138 coupled to the shaft 126 to co-rotate with the shaft 126 (e.g., by using a press-fit, a key and keyway arrangement, etc.; see also FIG. 6). The transmission 134 further includes a driven gear 142 rotatable about an axis 146 spaced from the axis 90 of rotation of the drive gear 138 and the input device 86. With reference to FIG. 4, the transmission 134 also includes a speed-reducing gear train 150 interconnecting the drive gear 138 and the driven gear 142. In the illustrated construction of the starter assembly 70, the gear train 150 includes a first set 154 of speed-reducing gears, a second set 158 of speed-reducing gears, and an idler gear 162 interconnecting the first and second sets 154, 158 of speed-reducing gears. A post 166 extending from the interior surface of the cover 118 rotatably supports the first set 154 of speed-reducing gears, while a post 170 extending from an interior surface of the housing 82 rotatably supports the second set 158 of speed-reducing gears. Another post 174 extending from the interior surface of the cover 118 rotatably supports the idler gear 162. C-clips 132 are used to secure the first and second sets 154, 158 of speed-reducing gears and the idler gear 162 to the respective posts 166, 170, 174. The speed-reducing gear train 150 provides an overall speed reduction of about 140:1 between the drive gear 138 and the driven gear 142. Alternatively, the gear train 150 may include any of a number of different configurations of gears to provide a different overall speed reduction between the drive gear 138 and the driven gear 142.

With continued reference to FIG. 4, the starter assembly 70 includes an accumulator device 178 coupled to the driven gear 142. The accumulator device 178 includes an outer housing or drum 182 coupled to the driven gear 142 via a shaft 186 that rotatably supports the driven gear 142 within the housing 82. In the illustrated construction of the starter assembly 70, the shaft 186 is coupled to the drum 182 by a plurality of fasteners 190 (e.g., bolts; see FIG. 6). Alternatively, the shaft 186 and drum 182 may be coupled in any of a number of different ways, and in yet other constructions of the starter assembly 70, the shaft 186 may be integrally formed with the drum 182.

The accumulator device 178 also includes a spring 190 positioned within the drum 182. As shown in FIG. 4, the spring includes a radially-innermost end 194 and a radially-outermost end 198 affixed to an interior surface of the drum 182. In the illustrated construction of the accumulator device 178, the radially-outermost end 198 of the spring 190 includes a hook 202 inserted through a slot 206 in the drum 182 to secure the end 198 of the spring 190 to the drum 182. Alternatively, any number of different structures (e.g., fasteners, clamps, clips, etc.) or processes (e.g., welding, using adhesives, etc.) may be used to affix the radially outermost end 198 of the spring 190 to the drum 182. The accumulator device 178 further includes a hub 210 aligned with the rotational axis 146 of the driven gear 142 (see also FIGS. 5 and 6). In the illustrated construction of the starter assembly 70, the radially-innermost end 194 of the spring 190 is coupled to the hub 210 by a pin 214. Specifically, the radially-innermost end 194 of the spring 190 is folded upon itself to create a loop 218 through which the pin 214 is inserted to secure the radially-innermost end 194 of the spring 190 to the hub 210, such that the radially-innermost end 194 of the spring 190 co-rotates with the hub 210. Alternatively, the radially-innermost end 194 of the spring 190 may be coupled to the hub 210 for co-rotation with the hub 210 in any of a number of different ways.

Figure 5:
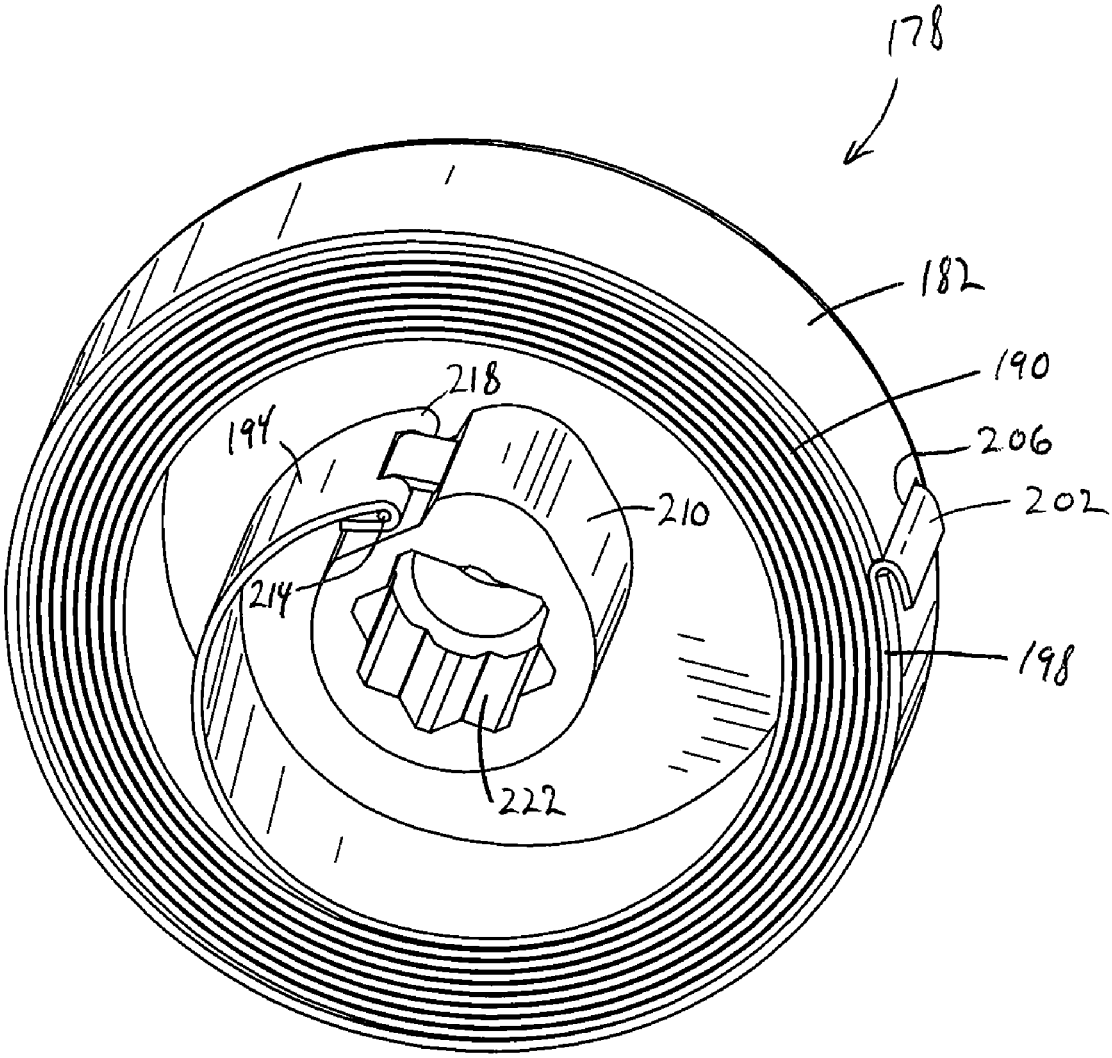
FIG. 5 is an assembled, bottom perspective view of an accumulator device of the engine starter assembly of FIG. 1

With reference to FIG. 5, the hub 210 includes a bore 222 through which a portion of a clutch 226 (see FIG. 4; described in more detail below) is received. In the illustrated construction of the starter assembly 70, the bore 222 includes a non-circular shape in which a member having a square cross-sectional shape may be received. Alternatively, the hub 210 may include a bore having any of a number of different non-circular shapes, or, in yet other constructions of the starter assembly 70, the hub 210 may incorporate a key and keyway arrangement with the clutch 226. With reference to FIGS. 4 and 6, the starter assembly 70 also includes a housing 230 in which the accumulator device 178 is positioned. In the illustrated construction of the starter assembly 70, the housing 230 is captured between an upper surface of a fan shroud 234 of the engine 14 and a lower surface of the housing 82, which itself is coupled to the fan shroud 234 by a plurality of legs 238 fastened to the fan shroud 234. The housing 230 is formed as a separate component from the fan shroud 234 and the transmission housing 12. Alternatively, the accumulator device housing 230 may be coupled to the engine 14 in any of a number of different ways, and, alternatively, the accumulator device housing 230 may be integrally formed with the fan shroud 234 and transmission housing 82.

With reference to FIG. 4, the starter assembly 70 also includes the previously-mentioned clutch 226 positioned between the accumulator device 178 and a rotatable member (e.g., the crankshaft 74) of the engine 14. As will be discussed in more detail below, the clutch 226 is configured to lock or engage while rotating at slow rotational speeds (e.g., less than about 700 revolutions/minute, and unlock or disengage while rotating at high rotational speeds (e.g., greater than about 700 revolutions/minute). As shown in FIG. 4, the clutch 226 includes a body 242 having an interior space 246, a plurality of balls 250 and a ratchet 254 positioned within the interior space 246 of the body 242, and a shaft 258 extending from the ratchet 254 (see also FIGS. 10 and 11). The interior space 246 of the body 242 is partially defined by a plurality of ramped surfaces 266 (see FIG. 6), each of which is oriented at an incline such that the respective balls 250 positioned within the interior space 246 are situated toward the bottom of the ramped surfaces 262 when the body 242 is stationary or rotating at slow rotational speeds as defined above.

Figure 10:
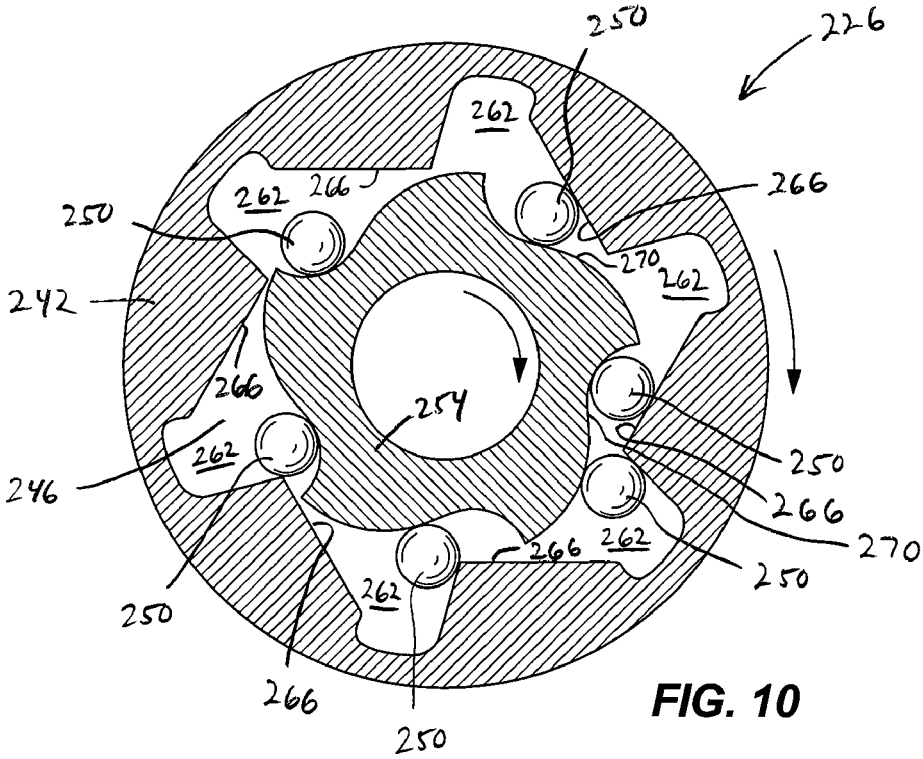
FIG. 10 is a cross-sectional view through a clutch incorporated in the engine starter assembly, illustrating the clutch in an engaged configuration.
Figure 11:
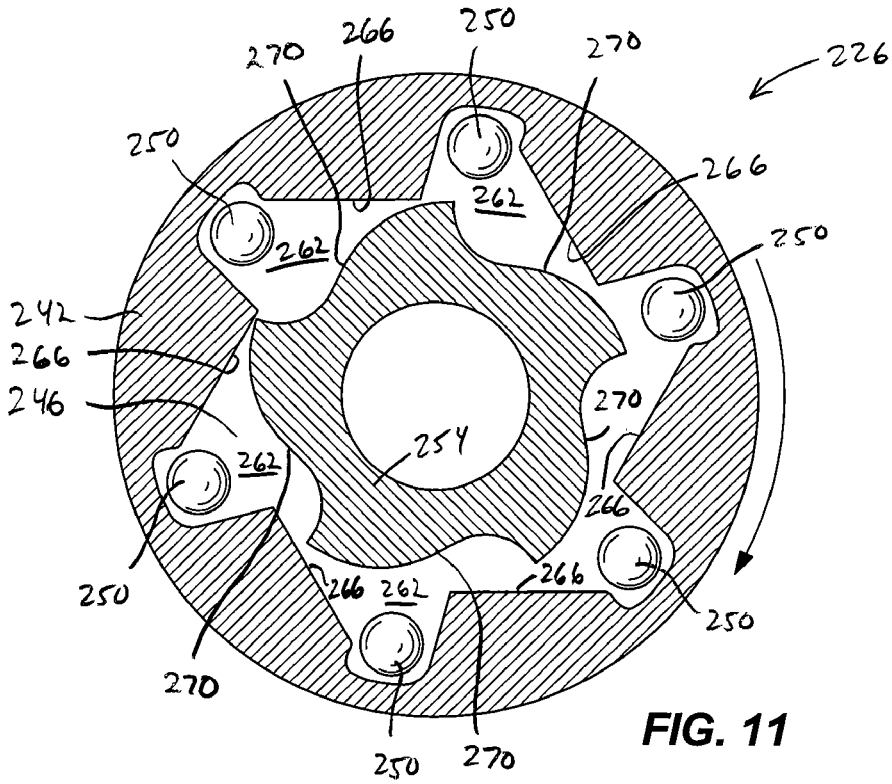
FIG. 11 is a cross-sectional view of the clutch shown in FIG. 10, illustrating the clutch in a disengaged configuration.

With reference to FIG. 10, the interior space 246 of the body 242 is partially defined by a plurality of cam surfaces 266 adjacent the respective ramped surfaces 262, and the ratchet 254 includes a plurality of cam surfaces 270. When the body 242 is stationary or rotating at slow rotational speeds as defined above, at least some of the respective cam surfaces 266, 270 of the body 242 and the ratchet 254 interlock with the balls 250, thereby locking the shaft 258 and the body 242 of the clutch 226 for co-rotation. With reference to FIG. 11, when the body 242 is rotating at high rotational speeds as defined above, the balls 250 move radially outwardly from the axis 146 of rotation of the clutch 226 and "up" the ramped surfaces 226 of the body 242. As a result, the respective cam surfaces 266, 270 of the body 242 and the ratchet 270 are free from interference with one another, and the ratchet 254 and shaft 258 are free to rotate relative to the body 242. The structure and operation of the clutch 226 is described in more detail in U.S. Pat. No. 6,311,663; the entire content of which is incorporated herein by reference.

With reference to FIG. 6, the body 242 of the clutch 226 is threaded to the crankshaft 74 of the engine 14 for co-rotation with the crankshaft 74. Alternatively, different structure (e.g., a key and keyway arrangement, etc.), or any of a number of different processes (e.g., using a press-fit, welding, adhesives, etc.), may be utilized to affix the body 242 of the clutch 226 to the crankshaft 74 such that the body 242 co-rotates with the crankshaft 74. Although the body 242 of the clutch 226 is coupled to the crankshaft 74 in the illustrated construction of the starter assembly 70, the body 242 may alternatively be coupled to another rotatable member of the engine (e.g., the fan/flywheel assembly 78).

Figure 8:
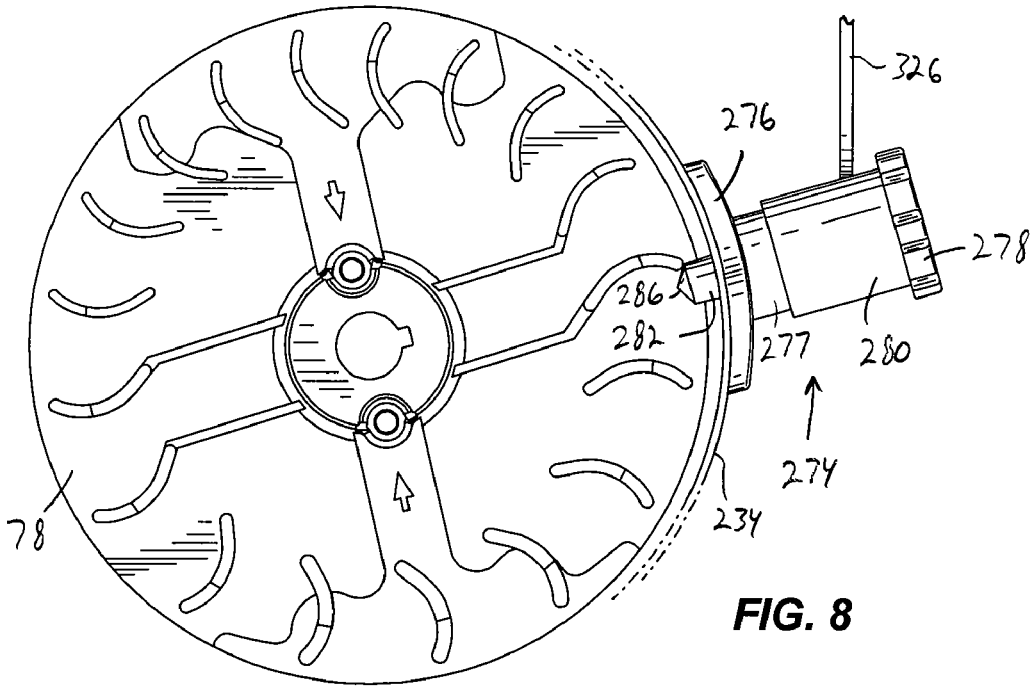
FIG. 8 is a top cutaway view of the engine starter assembly of FIG. 1, illustrating a locking device engaged with a fan/flywheel assembly of the engine.

With reference to FIGS. 2 and 8, the starter assembly 70 further includes a locking device 274 that selectively prevents rotation of the fan/flywheel assembly 78 and the crankshaft 74, such that the engine 14 is prevented from starting. The locking device 274 includes a base 276 having exterior threads formed on a cylindrical portion 277 of the base 226, a knob 278 having a cylindrical portion 280 with matching internal threads, and a shaft 282 extending from the knob 278. As shown in FIG. 8, the locking device 274 is supported by a portion of the engine 14, and a distal end 286 of the shaft 282 opposite the knob 278 protrudes into the engine 14 to selectively engage the fan/flywheel assembly 78 to prevent rotation of the fan/flywheel assembly 78 and start-up of the engine 14. In the illustrated construction of the starter assembly 70, the base 226 is supported by the fan shroud 234, and the distal end 286 of the shaft selectively engages one of the blades of the fan/flywheel assembly 78. Alternatively, the distal end 286 of the shaft 282 may selectively engage a different portion of the fan/flywheel assembly 78, or, in yet other constructions of the starter assembly 70, the distal end 286 of the shaft 282 may selectively engage another rotatable member of the engine 14. The threaded arrangement between the respective cylindrical portions 277, 280 of the base 276 and the knob 278 facilitates axial movement of the shaft 282 upon rotation of the knob 278. Alternatively, different structure between the respective cylindrical portions 277, 280 of the base 276 and the knob 278 (e.g., a quarter-turn arrangement) may be utilized to transform rotational movement of the knob 278 to axial movement of the shaft 282.

With reference to FIG. 3, the pressure washer assembly 10 includes a distribution member in the form of a block 290 having an inlet 294, a first outlet 298 in fluid communication with an inlet 302 of the pump 18, and a second outlet 306 in fluid communication with the nozzle 102. A flexible hose 310 may connect the inlet 294 of the distribution block 290 with a household source of pressurized fluid (e.g., a water spigot). In the illustrated construction of the pressure washer assembly 10, another flexible hose 314 interconnects the first outlet 298 of the distribution block 240 and the inlet 302 of the pump 18. Alternatively, different structure may be utilized to fluidly communicate the first outlet 298 of the distribution block 290 and the inlet 302 of the pump 18, or, in yet other constructions of the pressure washer assembly 10, the distribution block 290 may be integrally formed with the pump 18. With continued reference to FIG. 3, another flexible hose 318 interconnects the second outlet 306 of the distribution block 290 and the nozzle 102.

Figure 9:
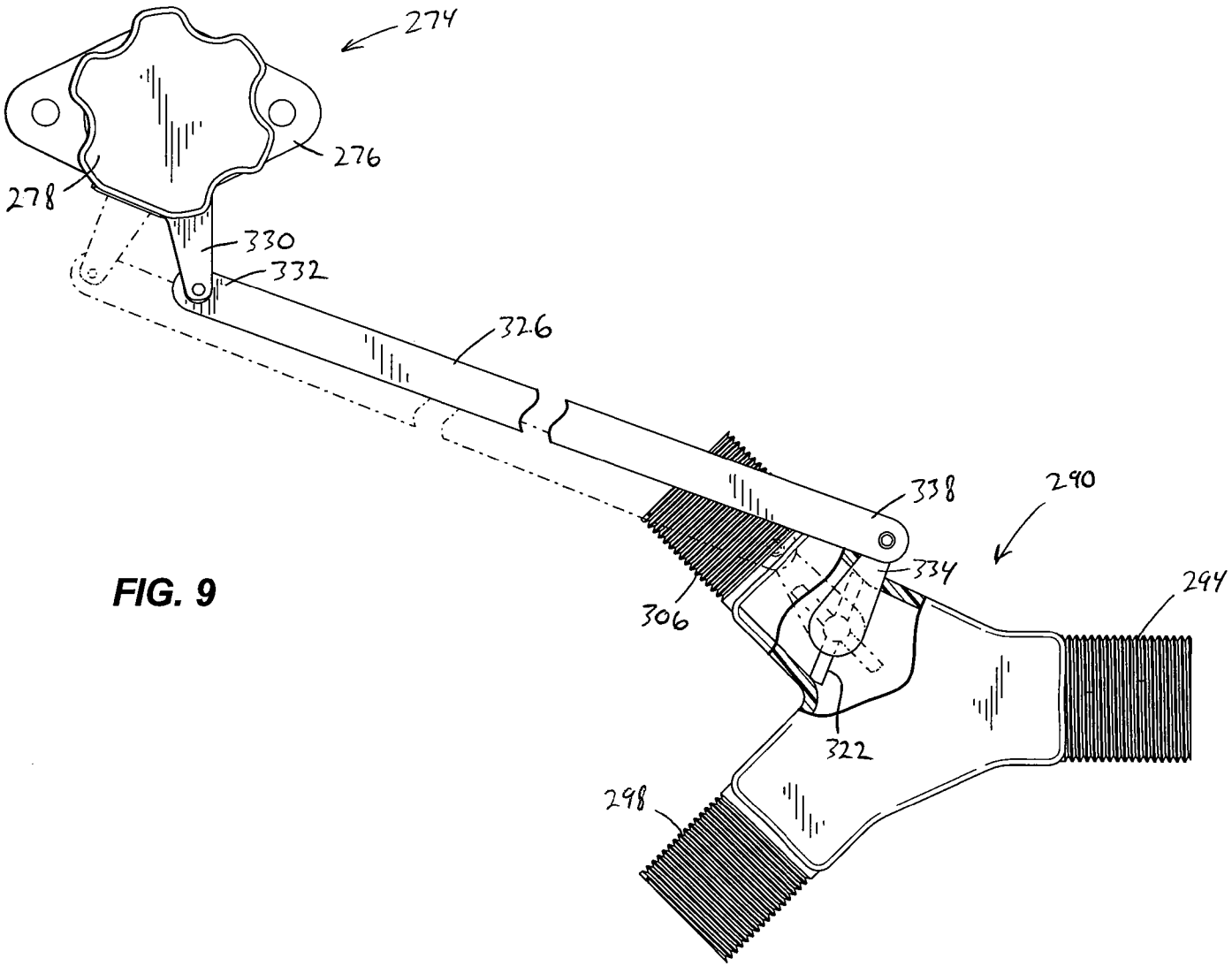
FIG. 9 is a side view of the locking device shown in FIG. 8 interconnected with a fluid distribution block of the pressurized fluid delivery apparatus, illustrating the locking device moved to a non-engaging position relative to the fan/flywheel assembly.

With reference to FIG. 9, a valve 322 positioned in the distribution block 290 is movable between a first position (shown in phantom), in which fluid flow is permitted from the inlet 294 of the distribution block 290 to the second outlet 306, and a second position (shown in solid), in which fluid flow from the second outlet 306 of the distribution block 290 is blocked. In the illustrated construction of the pressure washer assembly 10, a linkage 326 interconnects the knob 278 of the locking device 274 and the valve 322, such that movement of the knob 278 is transferred to the valve 322. Specifically, the linkage 326 is configured to transfer rotation of the knob 278 to the valve 322 to rotate the valve 322 between the first position and the second position. As shown in FIG. 9, the knob 278 includes an arm 330 rotatably coupled to a first end 332 of the linkage 326 (e.g., by a pin). The valve 322 includes an arm 334, accessible from the exterior of the distribution block 240, rotatably coupled to a second end 338 of the linkage 326 (e.g., by a pin). Alternatively, a different structure may be utilized to transfer movement of locking device 224 to the valve 322 to move the valve 322 between the first position and the second position. It should be understood that other structure, besides the block 290 and the valve 322, may be utilized to selectively impinge the fluid stream or fluid jet on the input device 86 to wind the spring 190 and store energy in the accumulator device 178.

In operation of the pressure washer assembly 10, the engine starter assembly 70 stores energy accumulated from the fluid stream or fluid jet discharged from the nozzle 102, and uses or releases the stored energy to start the engine 14. In preparing the pressure washer assembly 10 for use, the user would first connect the flexible hose 310 to the inlet 294 of the distribution block 290 to access a residential or utility source of pressurized fluid. Initially, the locking device 274 is rotated to a position (shown in FIG. 8) in which the distal end 286 of the shaft 282 engages the fan/flywheel assembly 78 to prevent rotation of the fan/flywheel assembly 78. When the locking device 274 is in this position, the starter assembly 70 is in a "locked-out" configuration. Because the locking device 274 and the valve 322 are interconnected by the linkage 326, the valve 322 is initially rotated to its first or open position to allow fluid flow from the inlet 294 of the distribution block 290 to the second outlet 306 of the distribution block 290 (shown in phantom in FIG. 9).

Figure 12:
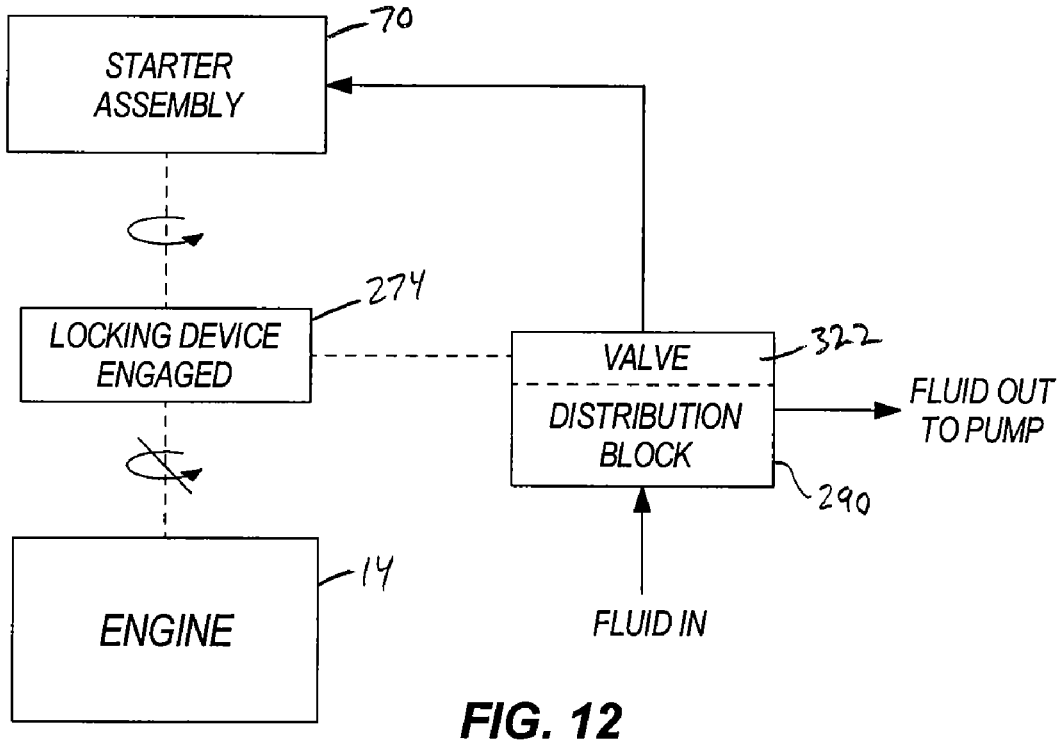
FIG. 12 is a schematic illustrating the engine starter assembly of FIG. 1 in which a pressurized fluid is diverted toward the engine starter assembly and torque is prevented from being transferred from the engine starter assembly to an engine.
Figure 13:
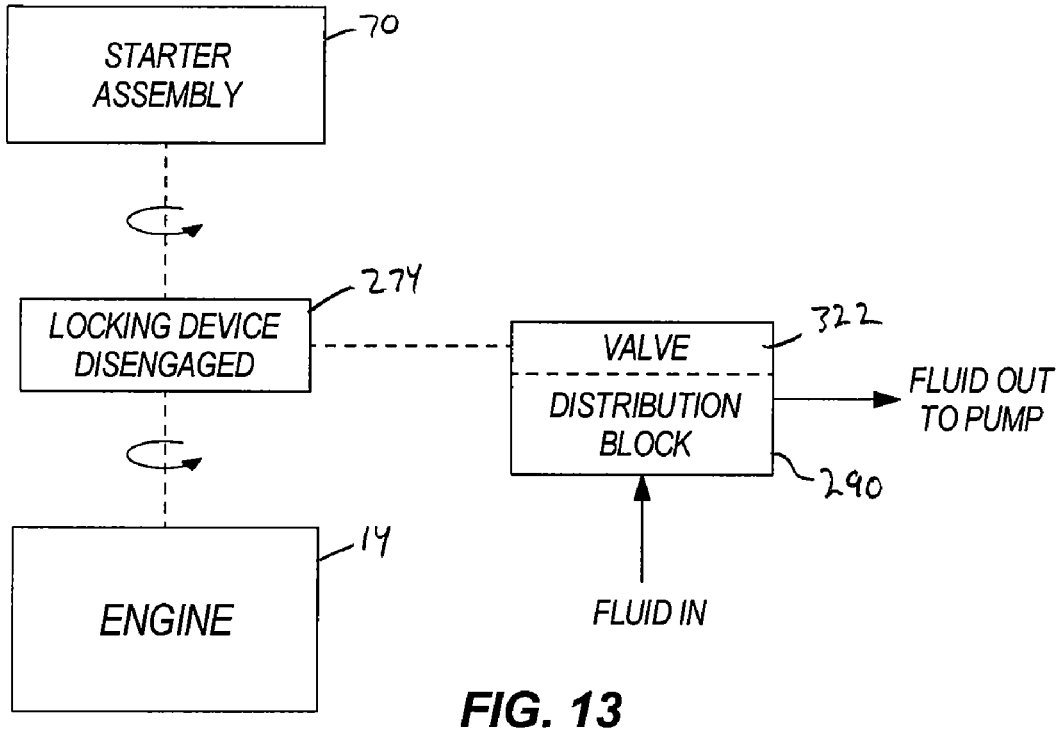
FIG. 13 is a schematic illustrating the engine starter assembly of FIG. 1 in which pressurized fluid is blocked from flowing toward the engine starter assembly and torque is transferred to the engine to start the engine.

The interaction of the locking device 274 and the valve 322 is illustrated in the schematics of FIGS. 12 and 13. FIG. 12 illustrates the interaction of the locking device 274 and the valve 322 prior to engine startup. As discussed above, the locking device 274 is initially engaged with the fan/flywheel assembly 78 to prevent rotation of the fan/flywheel assembly 78. Also, the valve 322 is in its open position to allow fluid flow from the inlet 294 to the second outlet 306. Upon initiation of fluid flow into the distribution block 290, fluid is allowed to flow through the first outlet 298 toward the inlet 302 of the pump 18, and through the second outlet 306 toward the nozzle 102 in the starter assembly 70. With reference to FIG. 7, fluid discharged from the nozzle 102 impinges upon the individual input members 94 of the input device 86, as described above, causing the input device 86 to rotate about its axis 90.

With reference to FIG. 6, rotation of the input device 86 drives the transmission 134, which provides a reduced speed and increased torque to the shaft 186 of the driven gear 142. Because the shaft 186 is fixed for rotation on the drum 182, the drum 182 co-rotates with the shaft 186 and the driven gear 142. However, the hub 210 is prevented from rotating with the drum 182 because the clutch 226 is in its locked configuration, as described above, and the locking device 274 is engaged to the fan/flywheel assembly 78 to prevent it from rotating. As a result, rotation of the drum 182 relative to the hub 210 resiliently deforms or winds the spring 190 to store energy in the spring 190. In the illustrated construction of the starter assembly 70, the spring 190 will continue to wind until the force exerted by the fluid jet on the individual input members 94 of the input device 86 is insufficient to overcome the reaction torque exerted on the input device 86, through the transmission 134, by the spring 190. Alternatively, another clutch or other structure may be utilized to disengage the input device 86 from the accumulator device 178 after the spring 190 reaches a predetermined spring tension. This series of events is schematically illustrated in FIG. 12.

To start the engine 14, the user needs only to attach the hose 310, turn on the fluid source, and rotate the knob 278 of the locking device 274 to the position shown in solid in FIG. 9. Specifically, rotating the knob 278 to the position shown in FIG. 9 causes the shaft 282 to axially displace away from the fan/flywheel assembly 78, thereby disengaging the distal end 286 of the shaft 282 and one of the blades of the fan/flywheel assembly 78. Because the fan/flywheel assembly 78 and the crankshaft 74 are no longer prevented from rotating, the spring 190 is allowed to unwind and rotate the hub 210, the clutch 226 (which is initially in its locked configuration as described above), and the crankshaft 74 to start the engine 14. As the knob 278 is rotated toward the position shown in solid in FIG. 9, the linkage 326 causes the valve 322 to rotate to its closed position to block fluid flow toward the nozzle 102. As a result, all of the fluid flow entering the distribution block 290 through the inlet 244 is directed toward the first outlet 298 of the distribution block 240 and ultimately to the inlet 302 of the pump 18. This series of events is schematically illustrated in FIG. 13.

After the engine 14 has started, the body 242 of the clutch 226 overruns the ratchet 254, allowing the balls 250 in the clutch 226 to be flung radially outwardly due to centrifugal forces acting on the balls 250, and up the respective ramped surfaces 262 of the body 242. The governed speed of the engine 14 is sufficient to maintain the balls 250 in a position radially outward of the cam surfaces 266 on the body 242 (see FIG. 11). As such, the body 242 is free to rotate relative to the ratchet 254 during operation of the engine 14, preventing reverse-winding of the spring 190. After the engine 14 is shut off, the centrifugal forces acting on the balls 250 are eliminated, allowing the balls 250 to roll down the ramped surfaces 262 toward the respective cam surfaces 266 of the body 242 to reset the clutch 262 in its locked configuration. The locking device 224 may also include a reset device configured to rotate the locking device 224 from the position shown in solid in FIG. 9 to the position shown in phantom in FIG. 9 to reengage the distal end 286 of the shaft 282 and the fan/flywheel assembly 78 to prevent rotation of the fan/flywheel assembly 78. Consequently, the linkage 326 would rotate the valve 322 back to its open configuration to again allow fluid flow from the inlet 244 of the distribution block 290 through the second outlet 306, and toward the nozzle 102.

Various features of the invention are set forth in the following claims.

What is claimed is:

1. A pressure washer connected to a water source by a hose, the pressure washer comprising:
- a frame;
- an engine supported by the frame, the engine including a crankshaft;
- a pump driven by the engine;
- a wheel supported for rotation relative to the frame;
- an input configured to receive water from the hose and discharge the water against the wheel to cause the wheel to rotate; and
- a spring having a first end that is coupled to the crankshaft and a second end that is rotatable about an axis relative to the first end in response to rotation of the wheel to wind the spring;
- wherein the wound spring is released to rotate the crankshaft to start the engine.

2. The pressure washer of claim 1, wherein the wheel includes an axis of rotation and a plurality of paddles arranged about the axis of rotation, and wherein the input is configured to discharge water against the paddles to cause the wheel to rotate.

3. The pressure washer of claim 1, further comprising a transmission positioned between the wheel and the spring configured to transfer rotation of the wheel to the second end of the spring to wind the spring.

4. The pressure washer of claim 1, further comprising a clutch, positioned between the spring and the crankshaft, configured to transfer movement between the spring and the crankshaft.

5. The pressure washer of claim 1, further comprising a lock configured to engage the crankshaft to prevent rotation of the crankshaft while the spring is being wound.

6. A pressure washer connected to a water source by a hose, the pressure washer comprising:
- a frame;
- an engine supported by the frame, the engine including a crankshaft;
- a pump driven by the engine;
- an engine starter assembly including
  - a housing supported by at least one of the frame and the engine;
  - a wheel rotatably supported by the housing;
  - an input configured to receive water from the hose and discharge the water against the wheel to cause the wheel to rotate;
  - a spring having a first end and a second end that is rotatable about an axis relative to the first end in response to rotation of the wheel;
  - a transmission positioned between the wheel and the spring configured to transfer rotation of the wheel to the second end of the spring to wind the spring;
  - a clutch that connects the first end of the spring to the crankshaft to transfer movement between the spring and the crankshaft; and
  - a lock configured to engage the crankshaft to prevent rotation of the crankshaft while the spring is being wound;
- wherein the wound spring is released by disengaging the lock to rotate the crankshaft and start the engine.

7. A pressurized fluid-delivery apparatus comprising:
- a frame;
- an engine supported by the frame, the engine including a rotatable member;
- a pump driven by the engine to discharge a pressurized fluid;
- an engine starter assembly including
  - an accumulator device coupled to the rotatable member, the accumulator device configured to store energy;
  - an input device coupled to the accumulator device and configured to impart a force on the accumulator device to move at least a portion of the accumulator device; and
  - a fluid input configured to receive the fluid stream and direct the fluid stream toward the input device to move the input device;
- wherein energy from the fluid stream is stored in the accumulator device due to the impingement of the fluid stream on the input device, and wherein the stored energy in the accumulator device is thereafter released to rotate the rotatable member to start the engine.

8. The pressurized fluid delivery apparatus of claim 7, wherein the input device includes an axis of rotation and a plurality of input members arranged about the axis of rotation, and wherein the plurality of input members are configured to be impinged by the fluid stream to cause the input device to rotate.

9. The pressurized fluid delivery apparatus of claim 8, wherein each of the input members includes an arcuate surface configured to be impinged by the fluid stream.

10. The pressurized fluid delivery apparatus of claim 7, further comprising a transmission positioned between the input device and the accumulator device configured to transfer movement of the input device to the accumulator device.

11. The pressurized fluid delivery apparatus of claim 10, wherein the transmission includes a plurality of gears arranged in a speed-reducing geartrain.

12. The pressurized fluid delivery apparatus of claim 10, wherein the transmission includes a first gear coupled to the input device and configured to rotate at a first speed about a first axis of rotation;

a second gear coupled to the accumulator device and configured to rotate at a second speed about a second axis of rotation;

wherein the first speed is greater than the second speed.

13. The pressurized fluid delivery apparatus of claim 7, wherein the accumulator device includes a housing rotatable about an axis of rotation;

a hub positioned in the housing coaxial with the axis of rotation; and a spring interconnecting the hub and the housing.

14. The pressurized fluid delivery apparatus of claim 13, wherein the housing is configured to rotate relative to the hub in response to movement of the input device to wind the spring.

15. The pressurized fluid delivery apparatus of claim 13, further comprising a clutch, positioned between the hub and the rotatable member, configured to selectively transfer movement between the hub and the rotatable member.

16. The pressurized fluid delivery apparatus of claim 7, further comprising a locking device configured to selectively engage the rotatable member to prevent rotation of the rotatable member.

17. The pressurized fluid delivery apparatus of claim 7, wherein the fluid input includes a nozzle.

18. The pressurized fluid delivery apparatus of claim 17, further comprising a housing in which the input device is at least partially positioned, wherein the nozzle is monolithically formed with the housing.

19. The pressurized fluid delivery apparatus of claim 7, further comprising a fluid distribution member including an inlet configured to be connected to a source of fluid;

a first outlet connected to the pump;

a second outlet connected to the fluid input; and a valve moveable between a first position, in which fluid is allowed to flow from the inlet to the second outlet, and a second position, in which fluid is blocked from flowing through the second outlet.

20. The pressurized fluid delivery apparatus of claim 19, further comprising a locking device moveable to selectively engage the rotatable member to prevent rotation of the rotatable member, wherein the valve is responsive to movement of the locking device, in which the locking device is disengaged from the rotatable member to move from the first position to the second position.

* * * * *